US008109512B2

(12) United States Patent
Gardiner et al.

(10) Patent No.: US 8,109,512 B2
(45) Date of Patent: Feb. 7, 2012

(54) CARD GAME

(76) Inventors: Mary E. Gardiner, Churchill (CA); Donald N. Gardiner, Churchill (CA)

( * ) Notice: Subject to any disclaimer, the term of this patent is extended or adjusted under 35 U.S.C. 154(b) by 169 days.

(21) Appl. No.: 12/451,283

(22) PCT Filed: Oct. 29, 2008

(86) PCT No.: PCT/IB2008/054494

§ 371 (c)(1),
(2), (4) Date: Nov. 4, 2009

(87) PCT Pub. No.: WO2009/063351

PCT Pub. Date: May 22, 2009

(65) Prior Publication Data

US 2010/0127457 A1 May 27, 2010

(51) Int. Cl.
*A63F 3/06* (2006.01)

(52) U.S. Cl. ..... 273/139; 273/292; 283/901; 283/903

(58) Field of Classification Search ..... 273/139, 273/292; 283/901, 903
See application file for complete search history.

(56) References Cited

U.S. PATENT DOCUMENTS 2,484,143 A * 10/1949 Arnold ..... 273/269
7,044,468 B2 5/2006 Sklansky et al.
2004/0121831 A1 6/2004 Perkins
2006/0043669 A1 3/2006 Gumina
2006/0111167 A1 5/2006 Breslo
2006/0197283 A1 9/2006 Thinnes
2007/0018406 A1 1/2007 Kennedy
2007/0063440 A1 3/2007 Patelidas
2007/0120322 A1 5/2007 Feola

OTHER PUBLICATIONS

"Texas Hold'Em Lottery", www.kslottery.com/Instnt Games/TexasHold'Em_673.html, printed Sep. 2007.
"Texas Hold'Em Poker", www.molottery.com/aboutourgames/promotions/WPT_texas_hold_em/details.shtm, printed Sep. 2007.

* cited by examiner

*Primary Examiner* — Benjamin Layno
(74) *Attorney, Agent, or Firm* — Richard C. Litman

(57) ABSTRACT

The card game combines aspects of Texas hold'em and raffle drawings. A plurality of mutually different cards or car representations is provided to each player as scratch-off or tear-off tickets, or cards in an envelope. A common multiple card hand is provided for player to form optimum hands with their card representations. The maximum number of player hands in a single distinct set, with each hand having mutually distinct cards therein, is determined by the number of cards in each hand and the number of distinct cards in the deck. The game may be played by a large group in lieu of conventional raffle ticket drawings, and provides for elimination of identical cards between each player hand and the common hand. At least one winning hand occurs with every game, as winning is comparative between players rather than absolute as in conventional raffle play.

16 Claims, 5 Drawing Sheets

22

CARD GAME

TECHNICAL FIELD

The present invention relates generally to games based on a conventional deck of fifty-two playing cards, and more specifically to a card game similar to poker.

BACKGROUND ART

The game of "Texas hold 'em" has become a very popular form of poker. The game begins by dealing two cards to each player, with players making initial and subsequent wagers in order to remain in the game. A series of five common cards are dealt sequentially, with players continuing to place wagers as the common cards are dealt in order to remain in the game. The best five-card combination comprising one or two cards from each player hand and either four or three cards selected from the five cards of the common hand wins the hand.

One problem with Texas hold 'em is that the game is limited to a relatively few live participants, due to the logistics involved in physically dealing cards to all players and the wagering system used in the game. In Texas hold 'em, several rounds of wagers are placed, with each player having to consider the wager or other action of the previous player in turn and either raise, check, call, or fold, as desired. It will be appreciated that in a game with a large number of players, the wagering system may become impossibly cumbersome.

As a result, computerized electronic variations of Texas hold 'em have been developed. In these computerized games, the players are not playing against one another, but rather play against the computer program and its randomly generated selection of card representations. The end result for a given player is generally the same, whether only a single player or a large number of players participates. Any wagers placed, and any winnings (or losses) are not necessarily dependent upon the number of other players participating, or their actions during a given hand, as in live play. Such computerized play is not suitable for use by relatively large groups of participants due to the lack of interaction between players in most such systems. Also, the cost and complexity of the computerized equipment required for play may be a limiting factor.

Another method of randomly selecting a winner from a group of participants is by means of the conventional raffle ticket, commonly used for the distribution of door prizes and similar awards at various events. Tickets for such activities are commonly printed as a roll of sequentially numbered ticket pairs, with the roll having two identically numbered tickets at each sequentially numbered position. Each participant receives one of the tickets from a given position on the roll, with the identically numbered ticket being placed into a common collection receptacle. While such a system readily determines a single winner from each drawing, there is no skill required on the part of the participants and the process is generally not particularly exciting or interesting for those involved. As a result, it has been known for at least some players to compare the numerical sequences of their tickets with one another, in order to determine a winning sequence (e.g., a pair, three of a kind, a straight, etc.), somewhat as in various games of poker. However, as there are no suits with such number sequences on tickets, this informal game is quite limited.

Thus, a card game solving the aforementioned problems is desired.

DISCLOSURE OF INVENTION

The card game is a poker-type game that may accommodate anywhere from a very few to a large number of participants. Each player is provided with a plurality of mutually distinct playing cards, preferably two cards or representations of cards. The values, i.e., the suits and ranks of these cards, comprising the player hands are unknown to each player before receipt. A series of cards, or representations of cards, is provided as a group of common cards for all players to use in forming an optimum poker hand. Each player or participant then selects some of the cards from the common cards to use in combination with his or her multiple card hand in order to form an optimum poker hand. The best hand comprising the cards of the player hand and selected common cards, wins the hand or round. Various means for breaking ties are also provided.

The card game is particularly suitable for selecting the winner of a drawing, door prize, or similar award at an event or gathering of people, although participants need not be gathered in a single location at any given time. A player card hand representation may be provided to each participant in the form of a preprinted article, the card representations being concealed until being revealed by the player, e.g., in the form of a "scratch-off" ticket, ticket with a peel-off cover, or even as actual cards contained within an envelope. The maximum number of player hands each having mutually distinct cards therein may be defined by the equation $H=[1/X][C][C-1]\ldots[C-(X-1)]$, where H is the maximum number of distinct player hands that may be generated, X is the number of cards in each player hand, and C is the number of distinct cards in the deck.

More specifically, the number of two-card player hands having distinct, separate cards in each hand is limited by the equation $H=\frac{1}{2}C(C-1)$, where H is the maximum number of distinct two card player hands that may be generated, and C is the number of distinct cards in the deck.

While it is expected that a conventional 52-card deck, comprising four suits of thirteen cards each, would be used for the play of the card game, it will be seen that other decks may also be used, if desired. For example, a pinochle deck comprises 48 cards in four suits, with each suit having twelve cards of six different ranks from nine upward through the ace, there being two identically ranked and suited cards for each rank and suit. Thus, half of the deck may be discarded, with the game being played using the remaining twenty-four distinct cards.

One aspect of the card game is the provision for the elimination of duplicate cards, either individually in each player hand or in the collective hand comprising the two-card player hand and the selected community cards. As the community cards are provided independently of the individual cards of the player hands, there may be some duplication of exact suit and rank between one or more player cards and one or more community cards, with this possibility increasing with increasing numbers of players. Accordingly, one rule of the card game is that any cards held by the player that are identical to the community cards are considered to be null and void in the player hand, and are not used in the formation of the poker hand by that player.

When using a conventional fifty-two card deck with two cards (or representations) provided to each player, the maximum number of distinct player hands possible is $\frac{1}{2}(52)(51)=1326$, in keeping with the $H=\frac{1}{2}C(C-1)$ equation noted further above. Additional participants may be accommodated by providing additional rounds of play, or, alternatively, by providing additional cards in each player hand. As an example of this latter alternative, the number of three card player hands possible is $\frac{1}{3}(52)(51)(50)=44{,}200$ distinct three card player hands without suit and rank duplication of cards in any hand.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

The present invention relates to various embodiments of a card game that combines aspects of the poker game of Texas hold 'em and raffle ticket procedures often held at various gatherings and functions. Rather than dealing individual card hands to the attendees at such a gathering, the card game issues cards or card representations in the form of a sealed "ticket" to each participant. The term "ticket" as used herein, is intended to describe an individual player hand of two or more playing cards or card representations, with those cards or representations initially concealed within a container, packet, envelope, or the like which the player may open to reveal the cards or card representations therein at an appropriate point during play. A single community hand comprising a series of cards or card representations is presented to the participants for them to use in combining their individual "ticket" cards to form multiple card poker hands.

The present card game is not limited to any specific number of cards or card representations in either the individual player hands or the community hand. However, it is preferred that each "ticket" or individual player hand contain two cards or card representations, and the community hand contain five cards or card representations. Such card representations may be in the form of preprinted indicia on a backing sheet for the individual "ticket" hands, or perhaps printed or otherwise displayed upon a large sheet (or even a video projection screen) for the community card hand.

Figure 1:
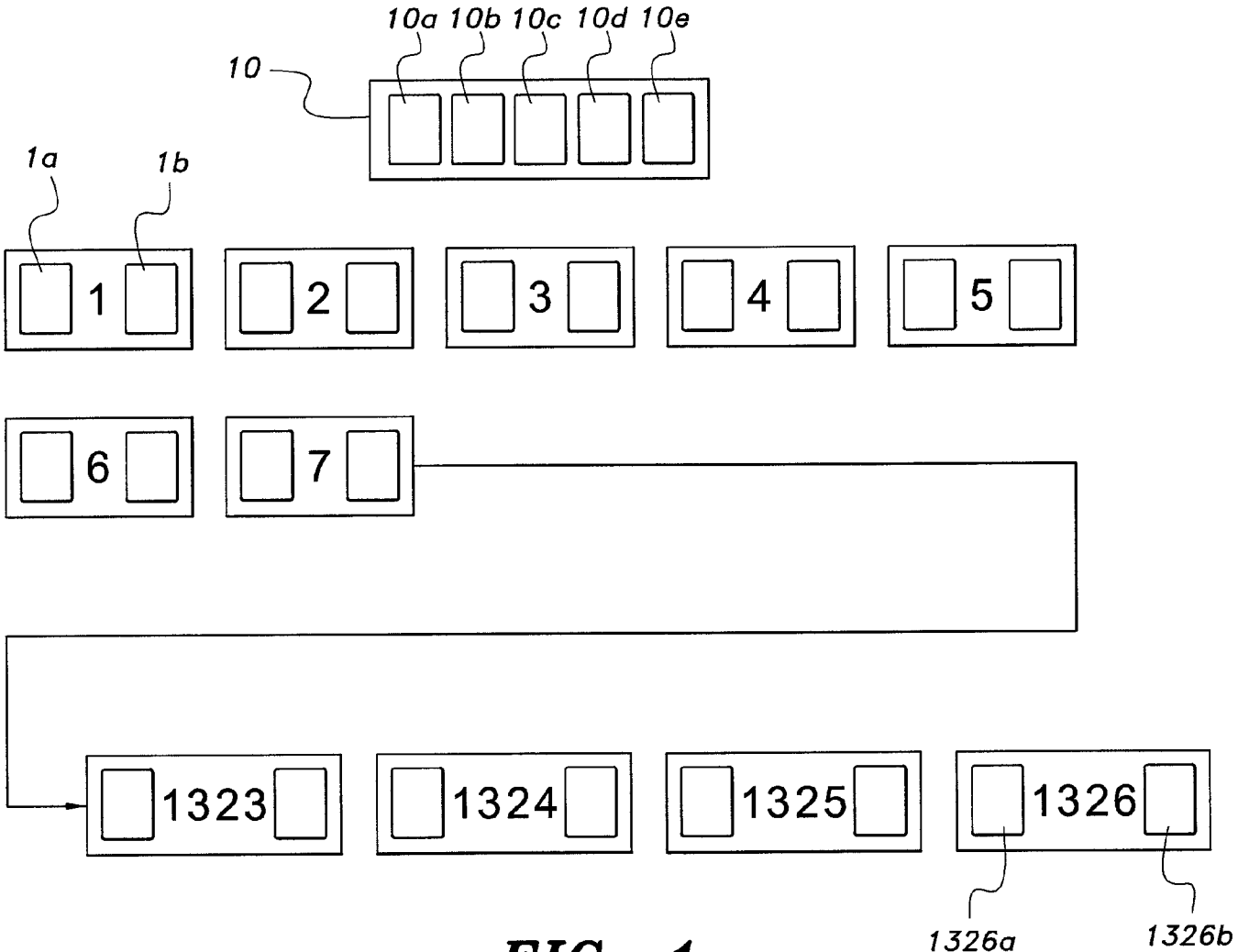
FIG. 1 is a schematic view representing a single five-card hand and the various two-card combinations of a card game according to the present invention.

The card game is limited by the number of card combinations available from the different ranked and suited cards in the card deck configuration used for the game and the number of cards used in each player hand. This maximum number of player hands may be defined generally by the equation $H=[1/X][C][C-1]\ldots[C-(X-1)]$, where H is the maximum number of distinct player hands which may be generated, X is the number of cards in each player hand, and C is the number of distinct, unduplicated cards in the deck. Preferably, the deck configuration used comprises a conventional poker deck having four suits each having thirteen cards, forming a 52-card deck. Preferably, each of the player hands contains only two cards or representations of cards available in the 52-card deck. In this example, the number of two card player hands having distinct, separate cards in each hand is limited by the equation $H=\frac{1}{2}C(C-1)$, where H is the maximum number of distinct two card player hands which may be generated, and C is the number of distinct cards in the deck. Thus, for a 52 card deck and two card player hands, $H=\frac{1}{2}(52)(52-1)$, $=1326$ possible different player hand combinations. This is represented by the series of individual player two card hands or tickets 1, 2, 3 . . . 1324, 1325, 1326 illustrated in FIG. 1 of the drawings, with each hand or ticket containing two cards or card representations therein, e.g., cards 1*a*, 1*b* for the ticket 1, 1326*a*, 1326*b* for the ticket 1326, etc. A community hand 10 containing five cards or card representations 10*a* through 10*e* is shown at the top of FIG. 1.

The game may be expanded readily to accommodate additional players by forming additional sets of player hands with a community hand for each set of player hands, as desired. If fewer than 1326 players or participants exist, the number of player hands may be reduced accordingly. It will be seen that there will always be at least one winning player regardless of how many or how few players there are in a round of play, as each player is competing against the other players in the round of play. This is unlike a raffle or lottery ticket scenario, in which the winner is determined by a single absolute number that must be matched. If no participant comes forth with the winning number, then no winner is determined for the round.

Figure 2:
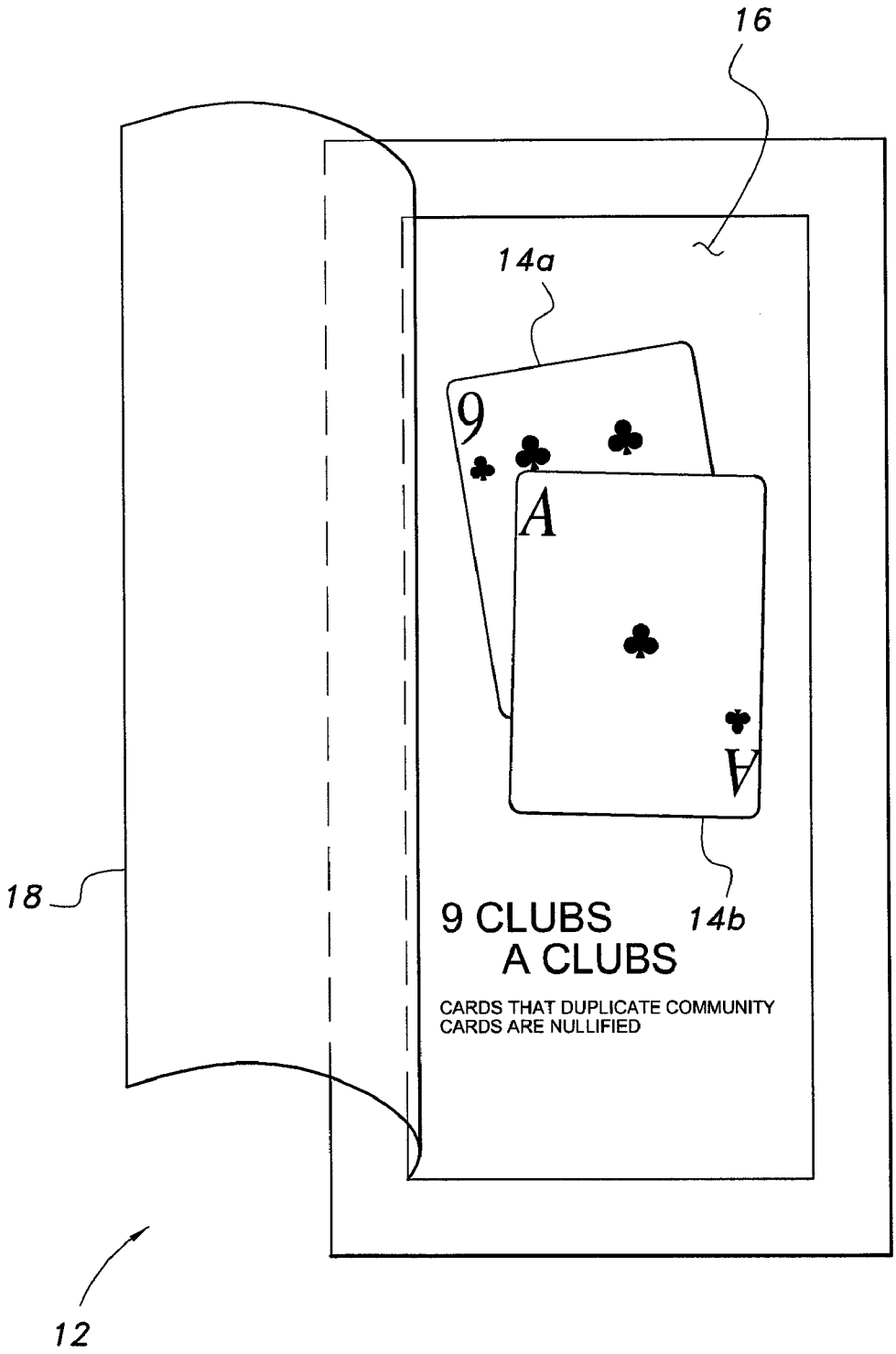
FIG. 2 is an exemplary two-card hand representation as provided in a tear-open ticket for a card game according to the present invention.

FIG. 2 of the drawings illustrates an exemplary player hand ticket 12 containing two card representations 14*a* and 14*b*. These card representations may comprise actual playing cards sealed within the ticket 12, or preprinted representations printed upon the backing sheet 16 of the ticket 12. The ranks and suits of the cards 14*a*, 14*b* may also be noted textually within the ticket 12, if so desired. An at least partially removable cover sheet 18 is sealed over the card representations 14*a*, 14*b* at the time the ticket 12 is presented to the player or participant, i.e., the player or participant cannot see or otherwise determine the ranks and suits of the two card representations contained within the ticket 12 at the time he or she receives the ticket. However, the cover sheet 18 may be readily opened or at least partially removed as shown in FIG. 2, when the player so desires or as directed when participating in the game.

Figure 3:
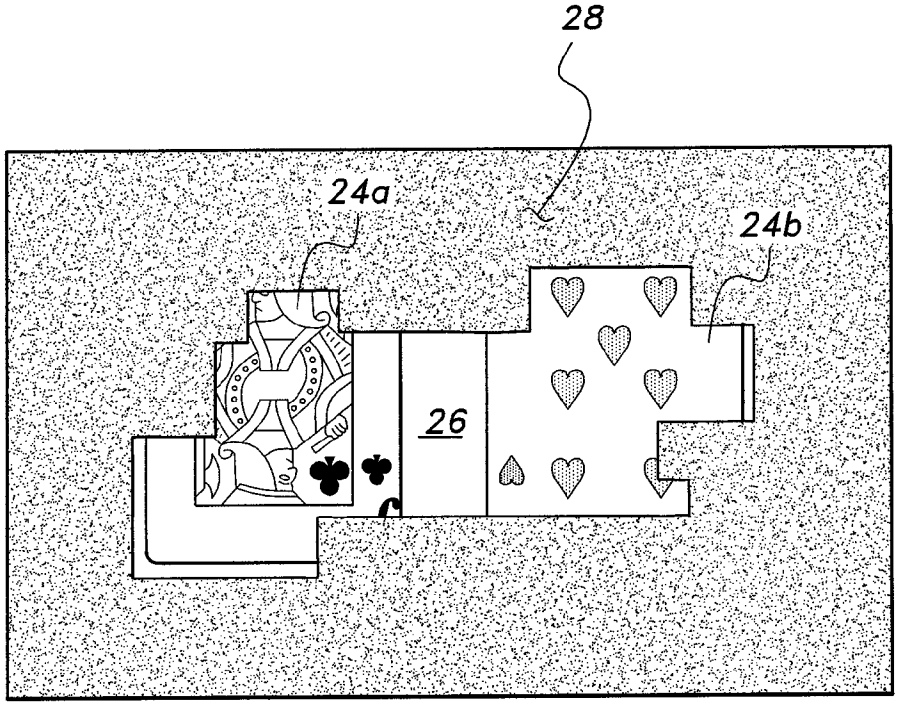
FIG. 3 is an exemplary two-card hand representation as provided in a scratch-off ticket for a card game according to the present invention.

FIG. 3 illustrates an alternative ticket form or configuration 22. The ticket 22 includes first and second card representations 24*a*, 24*b* printed on a backing sheet 26, with an opaque "scratch-off" coating or covering 28 disposed thereover. This coating or covering 28 is shown partially removed in FIG. 3, to show portions of the two card representations 24*a* and 24*b*.

Figure 4:
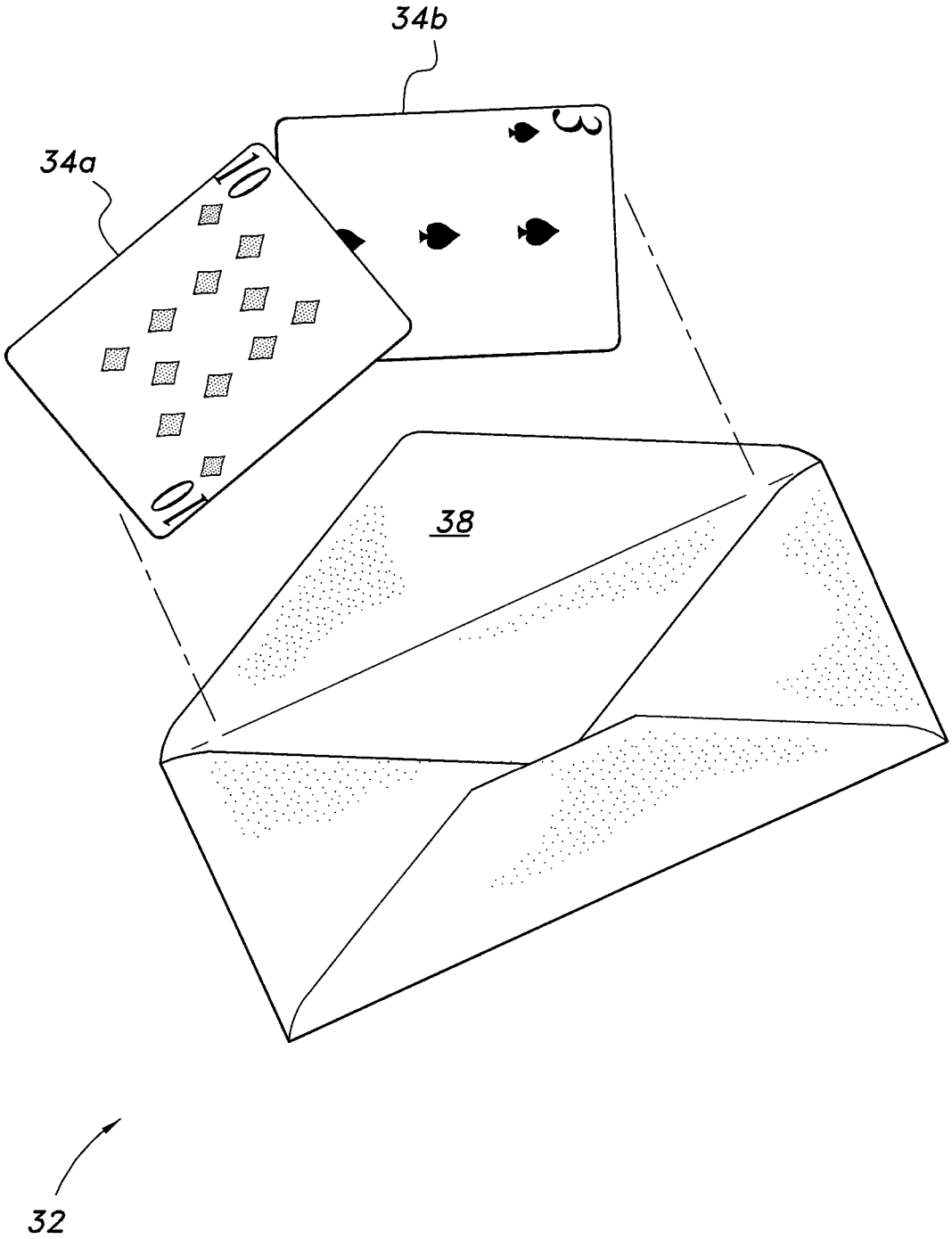
FIG. 4 is an exemplary two-card hand representation as provided in an envelope for a card game according to the present invention.

FIG. 4 is an illustration of another alternative means for providing the two cards or card representations of a player hand to the players. In FIG. 4, an envelope 32 is used to contain the two card representations 34*a* and 34*b* therein. The card representations may be actual playing cards when such an envelope ticket 32 is used, but it is preferable to use preprinted card representations rather than sorting through e.g., 52 decks of cards to gather each of the two card combinations required for a complete set of player hand tickets. The player or participant need only open the closure flap 38 to access the cards or card representations 34*a*, 34*b* therein.

Figure 5:
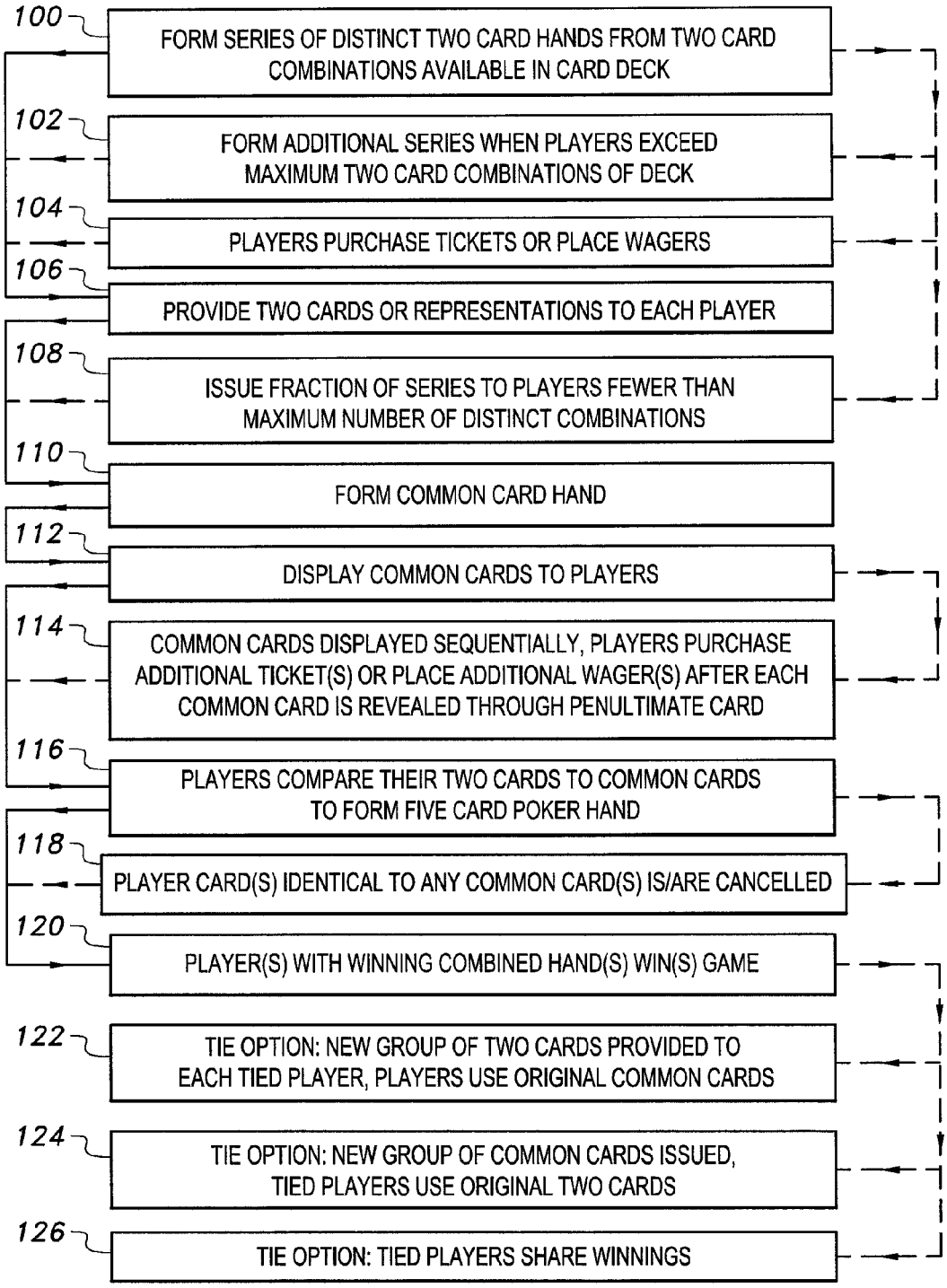
FIG. 5 is a flowchart showing the basic steps in the method of play of the card game according to the present invention.

FIG. 5 is a flow chart illustrating the basic steps in the method of play of the card game. Initially, a series of multiple card (e.g., two cards or card representations) individual player or participant hands is formed, using the available card combinations found in a conventional 52 card deck. The maximum number of such two card combinations is 1326, once all duplicated two card combinations are removed. This first step is indicated as the initial step 100 in FIG. 5. Alternatively, an additional set or sets of such player or participant hands may be formed in the same manner, with the second (and any subsequent) set(s) comprising an independent game. This optional alternative of providing additional series is indicated by the optional second step 102 in FIG. 5.

The card game lends itself well to play as a wagering, lottery, or raffle type game or activity. Accordingly, players or participants may be required to purchase a ticket, e.g., one of the tickets 12, 22, or 32 respectively of FIG. 2, 3, or 4, containing a plurality of playing cards or card representations. The payment for a ticket (or tickets, if the issuance of more than one ticket per player is permitted by the operators of the game) may be considered as an initial wager or "ante," to enter the game. This initial ticket purchase or wager is indicated as the third step 104 of the flow chart of FIG. 5. It should be noted that this step 104 is optional, as operation of the game as a wagering game or that the tickets be purchased is not an absolute requirement of the game.

The tickets are then issued to the players or participants in the form of concealed cards or card representations, as described further above and indicated generally by the fourth step 106 of FIG. 5. Players and participants cannot see or otherwise determine the suits and ranks of the cards or card representations when they are initially provided with their tickets, but may open their tickets at an appropriate time during play to expose and view their cards or representations. In the event that fewer than the maximum number of players are participating in the game, some fraction of the maximum number of player ticket card hands may be distributed in accordance with the number of players participating, as indicated by the optional fifth step 108 of FIG. 5.

At this point, a community or common card hand must be formed, if this has not been done earlier. The common or community card hand may be formed of five cards or card representations, or some other number if so desired. These community or common cards are displayed for all players or participants, either simultaneously or sequentially, in accordance with minor rule variations of the game. The formation of the community or common card hand and display of this community card hand to the players, is indicated respectively as the sixth and seventh steps 110 and 112 of FIG. 5. Optionally, the community cards may be displayed sequentially with players having the option of placing additional wagers on the outcome, or increasing their existing wager(s), or perhaps increasing their odds of attaining a winning card combination by purchasing additional player hand card tickets, if available. This optional sequential display of the community or common cards, and option for additional wagers or additional ticket purchases during play, is indicated as the optional eighth step 114 of FIG. 5.

At this point, the players may view the individual player cards or representations contained within their tickets, if they have not done so earlier. Depending upon the rules of the game, players typically may view the individual cards or representations of their tickets immediately or soon after receipt, if so desired. In any event, players must determine the ranks and suits of their individual ticket card representations by the time at least the first card of the community card group is revealed, so they may compare their cards with the community card(s) to form an optimum poker hand selected from their individual card tickets and the common hand. This is indicated by the ninth step 116 of FIG. 5.

It will be seen that on occasion, some of the cards or card representations of the individual player card tickets will be identical in suit and rank to one or more of the common cards. One rule of the game requires that when this occurs, any such identical cards between the player hand and the common hand (e.g., an ace of spades in the player hand and in the community hand) are canceled in the player hand, in accordance with play using a single conventional deck where none of the cards are identical to one another. This rule is indicated by the tenth step 118 of the flow chart of FIG. 5.

Players attempt to form optimum combination hands using the cards of their individual player ticket hands and the community hand, as noted further above and indicated in the ninth step 116 of FIG. 5. The various combination hands arrived at by the players are compared to determine a winning hand (or hands, in the case of ties), as indicated by the eleventh step 120 of FIG. 5. Where wagers have been placed in the game, the winning player is rewarded with a payoff in accordance with any house rules in effect.

It will be seen that from time to time there will be identically valued combination hands, resulting in ties. This becomes more likely with greater numbers of players. For example, two players may have straights with the same ranking cards, in different suits. As all suits are valued equally in poker, this results in a tie between the two player hands. The present card game provides various means for resolving such ties, or merely dividing any winnings between the tied players.

If it is desired that the tie be resolved, one means of doing so is by issuing each of the tied players a second individual card ticket. The tied players open these second tickets to view the cards or representations therein, and combine those new cards as desired to form a to new combination hand with the existing community hand. This procedure is indicated as the twelfth step 122 of FIG. 5.

Alternatively, a new community or common hand may be provided to resolve a tie. In this case, the tied players retain their original individual card hand tickets, and compare the cards or representations of their original tickets with the cards or representations of the new community cards to resolve the tie. This alternative is indicated as the thirteenth step 124 of FIG. 5.

Another alternative avoids the issuance of additional individual player hand tickets or community cards, and additional play. Rather, the payout (if any) is divided evenly between the tied players, as indicated by the optional fourteenth step 126 of FIG. 5.

In conclusion, the card game combines elements of the game of poker, particularly Texas hold 'em, with elements of raffle ticket drawing procedures. The game always provides at least one winner, as the winning hand is produced as a comparative activity between players, rather than as an absolute determination by the drawing of a number on a single raffle ticket. Yet, the game may be administered in much the same manner as a raffle drawing, with players or participants being issued one or more tickets having card or card representations therein for comparison to the community hand. The game thus provides a function much like that of raffle or lottery systems, while adding interest and excitement to the activity in the manner of a poker game.

It is to be understood that the present invention is not limited to the embodiment(s) described above, but encompasses any and all embodiments within the scope of the following claims.

The invention claimed is:

1. A method of playing a card game, comprising the steps of:

(a) providing card game apparatus including:

(i) a plurality of mutually distinct playing card tickets;

(ii) a plurality of mutually distinct playing card representations concealed within each of the tickets; and (iii) a community hand comprising a plurality of playing card representations, each of the card representations being randomly selected in real time during the play of the game and usable by each of the players;

(a) issuing one of the tickets to each player;

(b) revealing the playing card representations of each of the tickets, by each player; and (c) forming an optimum poker hand using the community card hand and the playing card representations of each of the tickets, by each player.

2. The method of playing a card game according to claim 1, wherein at least one of the tickets further includes a tear-open sheet removably concealing the plurality of playing card representations.

3. The method of playing a card game according to claim 1, wherein at least one of the tickets further includes a scratch-off surface removably disposed over the plurality of playing card representations.

4. The method of playing a card game according to claim 1, wherein at least one of the tickets comprises an envelope, the plurality of playing card representations being disposed therein.

5. The method of playing a card game according to claim 1, wherein the plurality of mutually distinct playing card representations consists of two playing card representations.

6. The method of playing a card game according to claim 1, wherein the community hand comprises five playing card representations.

7. The method of playing a card game according to claim 1, further including the step of canceling any card of the player hands identical to any of the cards of the community card hand.

8. The method of playing a card game according to claim 1, further including the step of placing wagers by all players prior to receiving their player hands.

9. The method of playing a card game according to claim 1, further including the steps of:

(a) displaying each of the cards of the community card hand, sequentially; and (b) placing additional wagers by continuing players after each of the cards of the community card hand is displayed.

10. The method of playing a card game according to claim 9, further including the step of issuing an additional player card hand to each continuing player after each of the cards of the community card hand is displayed.

11. The method of playing a card game according to claim 1, further including the steps of:

(a) determining at least one winning poker hand; and (b) rewarding the at least one player having the at least one winning poker hand.

12. The method of playing a card game according to claim 1, further including the steps of:

(a) determining the existence of any tied plurality of poker hands of equal maximum rank;

(b) issuing a new player card hand to each player having a tied poker hand; and (c) breaking the tie by forming an optimum poker hand using the community card hand and the new player card hand, by each player having a tied poker hand.

13. The method of playing a card game according to claim 1, further including the steps of:

(a) determining the existence of any tied plurality of poker hands of equal maximum rank;

(b) issuing a new community card hand; and (c) breaking the tie by forming an optimum poker hand using the new community card hand and the player card hand, by each player having a tied poker hand.

14. The method of playing a card game according to claim 1, further including the steps of:

(a) determining the existence of any tied plurality of poker hands of equal maximum rank; and (b) rewarding equally each player having a tied poker hand.

15. The method of playing a card game according to claim 1, further including the step of forming each of the multiple card player hands using two cards.

16. The method of playing a card game according to claim 1, further including the step of forming the community card hand using five cards.

* * * * *